US008038223B2

(12) United States Patent
Hall et al.

(10) Patent No.: US 8,038,223 B2
(45) Date of Patent: Oct. 18, 2011

(54) PICK WITH CARBIDE CAP

(75) Inventors: David R. Hall, Provo, UT (US); Ronald B. Crockett, Payson, UT (US)

(73) Assignee: Schlumberger Technology Corporation, Houston, TX (US)

( * ) Notice: Subject to any disclaimer, the term of this patent is extended or adjusted under 35 U.S.C. 154(b) by 478 days.

(21) Appl. No.: 11/851,582

(22) Filed: Sep. 7, 2007

(65) Prior Publication Data

US 2009/0066149 A1 Mar. 12, 2009

(51) Int. Cl.
*E21C 35/197* (2006.01)

(52) U.S. Cl. ..... 299/105; 299/111; 299/106

(58) Field of Classification Search ..... 299/104, 299/105, 106, 111, 112
See application file for complete search history.

(56) References Cited

U.S. PATENT DOCUMENTS

| | | | | |
|---|---|---|---|---|
| 2,004,315 | A | 6/1935 | Fean | |
| 2,124,438 | A | 7/1938 | Struk | |
| 3,254,392 | A | 6/1966 | Novkov | |
| 3,342,531 | A * | 9/1967 | Krekeler | 299/107 |
| 3,342,532 | A | 9/1967 | Krekeler | |
| 3,397,012 | A * | 8/1968 | Krekeler | 299/104 |
| 3,512,838 | A | 5/1970 | Kniff | |
| 3,655,244 | A | 4/1972 | Swisher | |
| 3,746,396 | A | 7/1973 | Radd | |
| 3,807,804 | A | 4/1974 | Kniff | |
| 3,830,321 | A | 8/1974 | McKenry | |
| 3,932,952 | A | 1/1976 | Helton | |
| 3,945,681 | A | 3/1976 | White | |
| 4,005,914 | A | 2/1977 | Newman | |
| 4,006,936 | A | 2/1977 | Crabiel | |
| 4,098,362 | A | 7/1978 | Bonnice | |
| 4,109,737 | A | 8/1978 | Bovenkerk | |
| 4,156,329 | A | 5/1979 | Daniels | |
| 4,199,035 | A | 4/1980 | Thompson | |
| 4,201,421 | A | 5/1980 | Den Besten | |
| 4,247,150 | A * | 1/1981 | Wrulich et al. | 299/104 |
| 4,268,089 | A | 5/1981 | Spence et al. | |
| 4,277,106 | A | 7/1981 | Sahley | |
| 4,439,250 | A | 3/1984 | Acharya | |
| 4,465,221 | A | 8/1984 | Schmidt | |
| 4,484,644 | A | 11/1984 | Cook | |
| 4,484,783 | A | 11/1984 | Emmerich | |
| 4,489,986 | A | 12/1984 | Dziak | |
| 4,583,786 | A | 4/1986 | Thorpe et al. | |
| 4,627,665 | A * | 12/1986 | Ewing et al. | 299/113 |

(Continued)

FOREIGN PATENT DOCUMENTS

| | | |
|---|---|---|
| DE | 3500261 | 7/1986 |

(Continued)

*Primary Examiner* — John Kreck
(74) *Attorney, Agent, or Firm* — Brinks Hofer Gilson & Lione

(57) ABSTRACT

A high-impact resistant pick having a superhard material bonded to a cemented metal carbide substrate at a non-planar interface. The cemented metal carbide substrate is bonded to a front end of a cemented metal carbide bolster. A bore formed in a base end of the carbide bolster is generally opposed to the front end. A steel body has a shaft extending distally from a shelf, and which shaft is fitted into the bore of the bolster at an interface. A shank adapted for connection to a driving mechanism extends proximally from the steel body opposite the shaft. A washer is disposed intermediate the base end of the carbide bolster and the shelf of the steel body.

26 Claims, 8 Drawing Sheets

U.S. PATENT DOCUMENTS 4,660,890 A 4/1987 Mills
4,678,237 A 7/1987 Collin
4,682,987 A 7/1987 Brady
4,684,176 A 8/1987 Den Besten et al.
4,688,856 A 8/1987 Elfgen
4,725,098 A 2/1988 Beach
4,728,153 A 3/1988 Ojanen et al.
4,729,603 A 3/1988 Elfgen
4,746,379 A * 5/1988 Rabinkin ..... 148/403
4,765,686 A 8/1988 Adams
4,765,687 A 8/1988 Parrott
4,776,862 A 10/1988 Wiand
4,804,231 A 2/1989 Buljan et al.
4,836,614 A 6/1989 Ojanen
4,850,649 A 7/1989 Beach
4,880,154 A 11/1989 Tank
4,921,310 A 5/1990 Hedlund
4,932,723 A 6/1990 Mills
4,940,288 A 7/1990 Stiffler
4,944,559 A 7/1990 Sionnet
4,951,762 A 8/1990 Lundell
5,007,685 A 4/1991 Beach et al.
5,011,515 A 4/1991 Frushour
5,112,165 A 5/1992 Hedlund
5,141,289 A 8/1992 Stiffler
5,154,245 A 10/1992 Waldenstrom
5,186,892 A 2/1993 Pope
5,251,964 A 10/1993 Ojanen
5,261,499 A 11/1993 Grubb
5,303,984 A 4/1994 Ojanen
5,332,348 A 7/1994 Lemelson
5,415,462 A * 5/1995 Massa ..... 299/106
5,417,475 A 5/1995 Graham
5,447,208 A 9/1995 Lund
5,503,463 A 4/1996 Ojanen
5,535,839 A 7/1996 Brady
5,542,993 A 8/1996 Rabinkin
5,653,300 A 8/1997 Lund
5,720,528 A 2/1998 Ritchey
5,725,283 A 3/1998 O'Neill
5,730,502 A 3/1998 Montgomery, Jr.
5,738,698 A 4/1998 Kapoor
5,823,632 A 10/1998 Burkett
5,837,071 A 11/1998 Anderson
5,845,547 A 12/1998 Sollami
5,875,862 A 3/1999 Jurewicz
5,884,979 A 3/1999 Latham
5,934,542 A 8/1999 Nakamura
5,935,718 A 8/1999 Demo
5,944,129 A 8/1999 Jenson
5,967,250 A 10/1999 Lund
5,992,405 A 11/1999 Sollami
6,006,846 A 12/1999 Tibbitts
6,019,434 A 2/2000 Emmerich
6,044,920 A 4/2000 Massa
6,051,079 A 4/2000 Andersson
6,056,911 A 5/2000 Griffin
6,065,552 A 5/2000 Scott
6,113,195 A 9/2000 Mercier
6,170,917 B1 1/2001 Heinrich
6,193,770 B1 2/2001 Sung
6,196,636 B1 3/2001 Mills
6,196,910 B1 3/2001 Johnson
6,199,956 B1 3/2001 Kammerer
6,216,805 B1 4/2001 Lays
6,270,165 B1 8/2001 Peay
6,341,823 B1 1/2002 Sollami
6,354,771 B1 3/2002 Bauschulte
6,357,832 B1 3/2002 Sollami
6,364,420 B1 4/2002 Sollami
6,371,567 B1 4/2002 Sollami
6,375,272 B1 4/2002 Ojanen
6,419,278 B1 7/2002 Cunningham
6,478,383 B1 11/2002 Ojanen
6,481,803 B2 11/2002 Ritchey
6,499,547 B2 12/2002 Scott
6,508,516 B1 1/2003 Kammerer
6,517,902 B2 2/2003 Drake
6,585,326 B2 7/2003 Sollami
6,644,755 B1 11/2003 Kammerer
6,685,273 B1 2/2004 Sollami
6,692,083 B2 2/2004 Latham
6,702,393 B2 3/2004 Mercier
6,709,065 B2 3/2004 Peay
6,719,074 B2 4/2004 Tsuda
6,733,087 B2 5/2004 Hall
6,739,327 B2 5/2004 Sollami
6,758,530 B2 7/2004 Sollami
6,786,557 B2 9/2004 Montgomery, Jr.
6,824,225 B2 11/2004 Stiffler
6,851,758 B2 2/2005 Beach
6,854,810 B2 2/2005 Montgomery, Jr.
6,861,137 B2 3/2005 Griffin
6,889,890 B2 5/2005 Yamazaki
6,962,395 B2 11/2005 Mouthaan
6,966,611 B1 11/2005 Sollami
6,994,404 B1 2/2006 Sollami
7,204,560 B2 4/2007 Mercier
2002/0070602 A1 6/2002 Sollami
2002/0074851 A1 6/2002 Montgomery
2002/0153175 A1 10/2002 Ojanen
2002/0175555 A1 11/2002 Mercier
2003/0137185 A1 * 7/2003 Sollami ..... 299/106
2003/0141350 A1 7/2003 Noro
2003/0141753 A1 7/2003 Peay et al.
2003/0209366 A1 11/2003 McAlvain
2003/0234280 A1 12/2003 Cadden
2004/0026132 A1 * 2/2004 Hall et al. ..... 175/427
2004/0026983 A1 2/2004 McAlvain
2004/0065484 A1 4/2004 McAlvain
2005/0044987 A1 * 3/2005 Takayama et al. ..... 75/236
2005/0159840 A1 7/2005 Lin
2005/0173966 A1 8/2005 Mouthaan
2006/0125306 A1 6/2006 Sollami
2006/0237236 A1 10/2006 Sreshta

FOREIGN PATENT DOCUMENTS

DE 3818213 11/1989
DE 4039217 6/1992
DE 19821147 11/1999
DE 10163717 5/2003
EP 295151 A * 12/1988
EP 0412287 7/1990
EP 1574309 9/2005
GB 2004315 3/1979
GB 2037223 11/1979
JP 5280273 A 10/1993

* cited by examiner

PICK WITH CARBIDE CAP

BACKGROUND OF THE INVENTION

Formation degradation, such as asphalt milling, mining, or excavating, may result in wear on attack tools. In excavating operations, often, a trenching machine comprises an array of attack picks disposed within holders that may be rotated and moved so that the attack picks engage a hard surface. Consequently, many efforts have been made to extend the life of these tools.

U.S. Pat. No. 4,274,678 to Herridge, which is herein incorporated by reference for all that it contains, discloses a mineral mining pick boss having a socket therein for the reception of a shank of a mineral mining pick and a locking arrangement for retaining the shank, the locking arrangement comprising a plug received in the bore extending through the boss transversely of the socket the arrangement being such that the bore intersects the socket, the plug comprising a body of a resilient material (e.g. neoprene) having bonded into the periphery thereof at spaced locations a plurality of metallic members one of which protrudes from the bore into the socket for frictional engagement with the shank of the tool so as to retain the tool in position, the other(s) of the metallic members being such that the plug may be removed from the bore, rotated and re-inserted to change the metallic member which protrudes into the socket.

U.S. Pat. No. 5,873,423 to Briese, which is herein incorporated by reference for all that it contains, discloses a frustum cutting bit arrangement, including a shank portion for mounting in, and to be retained by, a rotary cutting tool body, the shank portion having an axis, an inner axial end, and an outer axial end. A head portion has an axis coincident with the shank portion axis, a front axial end, and a rear axial end, the rear end coupled to the shank portion outer end, and the front end having a conical cavity therein diminishing in diameter from the front end toward the rear end. A frustum cutting insert has an axis coincident with the head portion axis, a forward axial end, a back axial end, and an outer conical surface diminishing in diameter from the forward end toward the back end, the conical cavity in a taper lock. In variations of the basic invention, the head portion may be rotatable with respect to the shank portion, the frustum cutting insert may comprise a rotating cutter therein, and combinations of such features may be provided for different applications.

U.S. Pat. No. 5,702,160 to Levankovskii et al., which is herein incorporated by reference for all that it contains discloses a tool for crushing hard material comprising a housing and a hard-alloy insert mounted on the latter. The insert is made up of a head portion, an intermediate portion and a base with a thrust face. The intermediate portion of the insert is formed by a body of revolution with an outer lateral surface of concave shape. The head portion of the insert is formed by a body of revolution with an outer lateral surface of convex shape. The lateral side of the head portion of the insert is smoothly located adjacent to the lateral side of the intermediate portion of the insert about its longitudinal axis does not exceed the length of the head portion of the insert about the same axis.

BRIEF SUMMARY OF THE INVENTION

In one aspect of the present invention, a high-impact resistant pick has a superhard material bonded to a cemented metal carbide substrate at a non-planar interface. The cemented metal carbide substrate is bonded to a front end of a cemented metal carbide bolster. A bore formed in a base end of the carbide bolster is generally opposed to the front end. A steel body has a steel shaft fitted into the bore of the bolster at an interface. The bore may be tapered. A shank adapted for connection to a driving mechanism extends from the steel body opposite the shaft. A washer is disposed intermediate the base end of the carbide bolster and a shelf of the steel body. The pick may be adapted for attachment to a trenching machine, mining machine, pavement milling machine, or a combination thereof.

The washer may be brazed intermediate the carbide bolster and the shelf of the steel body and may be adapted to rotate independent of the carbide bolster and the steel body. The washer may also have a wear-resistant coating. The carbide bolster and the shelf of the steel body may be adapted to compress the washer and thereby prohibit rotation of the washer. The washer and the body may comprise a tool steel. More specifically, the washer and the base may comprise S7 tool steel. A second washer may be disposed adjacent a base end of the shelf of the steel body.

A portion of the steel shaft adjacent the bore of the bolster may have a concave geometry. The shank may be held within a holder of the driving mechanism and may be lubricated. The interface of the shaft may compliant, thereby extending the life of the pick. The steel shaft may be press-fit into the bore of the carbide bolster, the press-fit having an interference of 0.0005 to 0.0020 inch. The bore of the carbide bolster may have a depth of 0.50 to 3 inches. The carbide substrate may have a thickness of 0.050 to 1.0 inch. In some embodiments the carbide substrate may have a thickness of 0.050 to 0.300 inch. The carbide substrate and carbide bolster may be brazed with a braze material comprising 30 to 62 weight percent of palladium.

The superhard material may have a substantially pointed geometry with an apex having a 0.050 to 0.160 inch radius, and a 0.100 to 0.500 inch thickness from the apex to the non-planar interface. The superhard material may be a material selected from the group consisting of diamond, monocrystalline diamond, polycrystalline diamond, sintered diamond, chemical deposited diamond, physically deposited diamond, natural diamond, infiltrated diamond, layered diamond, thermally stable diamond, silicon-bonded diamond, metal-bonded diamond, and combinations thereof.

In another aspect of the present invention, a high-impact resistant pick has a superhard material bonded to a cemented metal carbide substrate at a non-planar interface. The cemented metal carbide substrate is bonded to a front end of a cemented metal carbide bolster. A bore formed in a base end of the carbide bolster is generally opposed to the front end. A steel body has a steel shaft fitted into the bore of the bolster at an interface. The bore may be tapered. A shank adapted for connection to a driving mechanism extends from the steel body opposite the shaft. The base end of the carbide bolster is in contact with a shelf formed in the steel body.

DETAILED DESCRIPTION OF EXEMPLARY EMBODIMENTS

Figure 1:
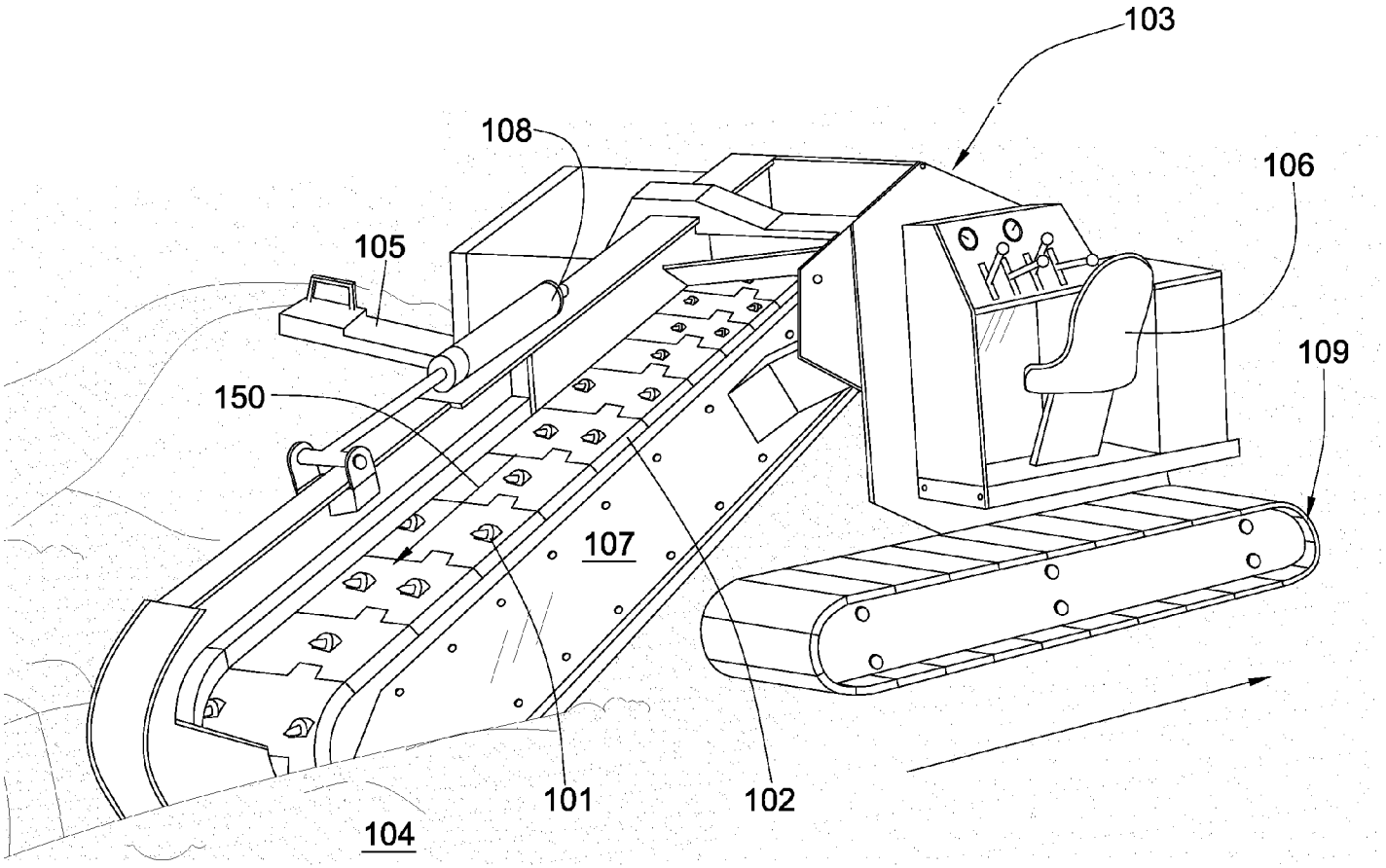
FIG. 1 is a perspective diagram of an embodiment of a plurality of picks on a rotating chain attached to a motor vehicle.

FIG. 1 illustrates a plurality of picks 101 on a rotating chain 102 attached to a motor vehicle 103, specifically, a trenching machine. In other embodiments, the picks may be adapted for attachment to a mining machine, pavement milling machine, or a combination thereof. The plurality of picks 101 may be exteriorly mounted in a "V" pattern on the chain 102 to facilitate degradation and removal of a formation 104. The rotating chain 102 rotates in a direction indicated by an arrow 150 and cuts the formation 104 forming a trench while bringing the formation cuttings out of the trench to a conveyor belt 105 which directs the cuttings to a side of the trench. The rotating chain 102 is supported by an arm 107. The arm 107 may be raised while the machine is being transported or it may be lowered for trenching as shown in FIG. 1. The position of the arm may be controlled by a hydraulic piston and cylinder 108. The trenching machine may move about the formation 104 by tracks 109, wheels, or a combination thereof A seat 106 for an operator is positioned on the side of the machine.

Figure 2:
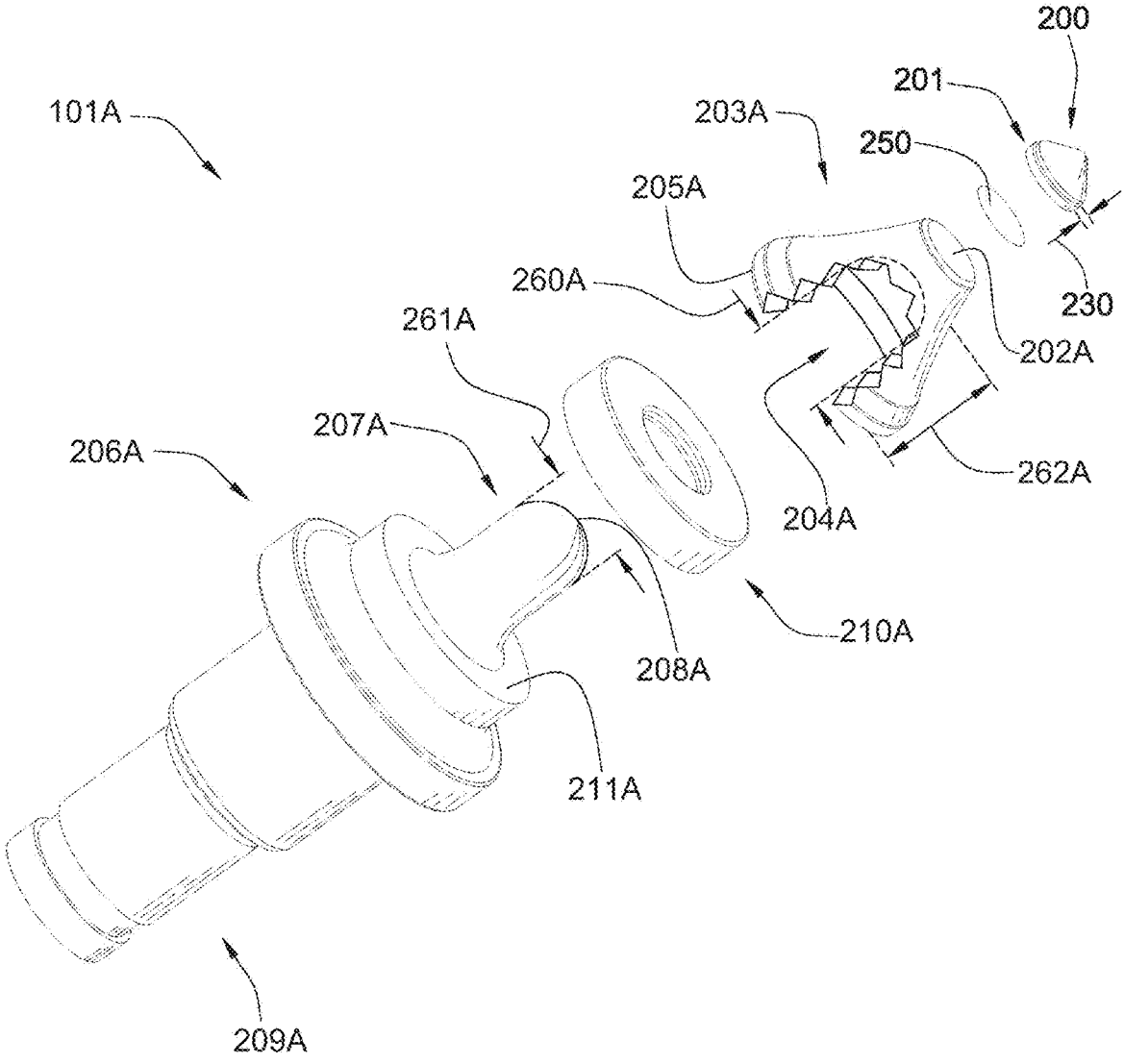
FIG. 2 is an exploded diagram of an embodiment of a pick.

FIG. 2 is an exploded diagram of an embodiment of a pick 101A. In one exemplary embodiment, the pick 101A has a superhard material 200 bonded to a cemented metal carbide substrate 201 at a non-planar interface. The superhard material may be a material selected from the group consisting of diamond, monocrystalline diamond, polycrystalline diamond, sintered diamond, chemical deposited diamond, physically deposited diamond, natural diamond, infiltrated diamond, layered diamond, thermally stable diamond, silicon-bonded diamond, metal-bonded diamond, and combinations thereof. The substrate 201 may comprise a thickness 230 of .050 to 1.0 inch. In a preferred embodiment, the substrate 201 comprises a thickness 230 of 0.050 to 0.300 inch. It has been discovered that incorporating a thin substrate into the pick may increase the life of the pick.

The cemented metal carbide substrate 201 may also be bonded to a front end 202A of a cemented metal carbide bolster 203A. In this embodiment, the substrate 201 may be brazed to the bolster 203A with a braze material 250 comprising 30 to 62 weight percent of palladium. A bore 204A may be formed in a base end 205A of the carbide bolster 203A generally opposed to the front end 202A. The bore 204A may comprise a depth 262A of 0.40 to 3 inches. The bore 204A may be tapered.

A steel body 206A having a steel shaft 207A may be fitted into the bore 204A of the bolster 203 at an interface 208A. The steel shaft 207A may be press-fit into the bore 204A of the carbide bolster 203A, the press-fit having an interference of 0.0005 to 0.0020 inch. This implies that the bore 204A of the carbide bolster 203A has a diameter 260A smaller than a diameter 261A of the steel shaft 207A. A shank 209A adapted for connection to a driving mechanism extends from the steel body 206A opposite the shaft 207A.

A washer 210A may be disposed intermediate the base end 205 of the carbide bolster 203 and a shelf 211A of the steel body 206A. The washer 210A and/or the steel body 206A may comprise a tool steel.

Figure 3:
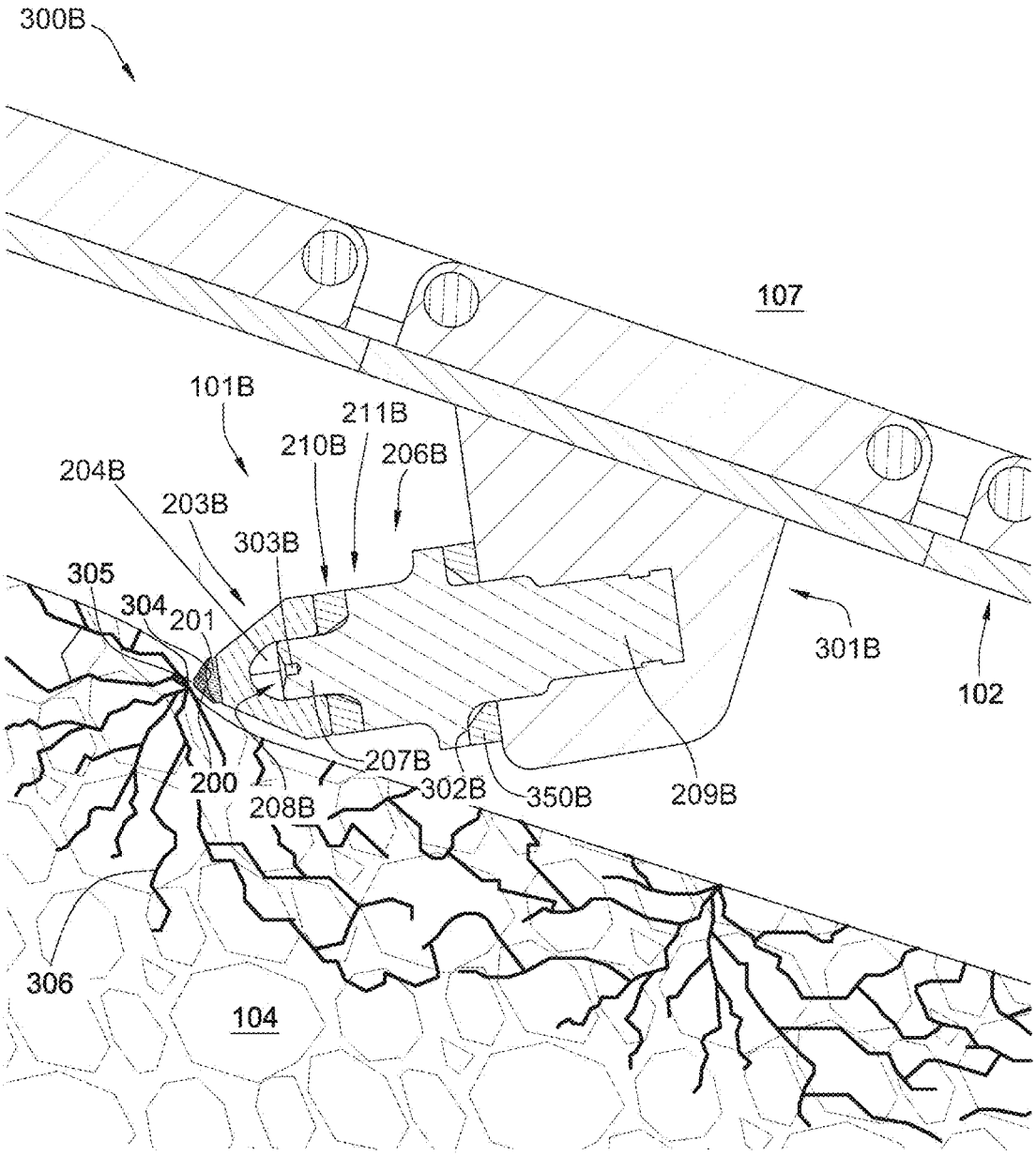
FIG. 3 is a cross-sectional diagram of an embodiment of a degradation assembly.

Referring now to FIG. 3, an embodiment of a degradation assembly 300B may comprise a holder 301B, a chain 102, and a pick 101B; the holder 301B being attached directly to the rotating chain 102 supported by the arm 107 of the trenching machine. In one embodiment, the holder 301B may be welded to the chain 102. In other embodiments, the holder may be bolted to the chain.

The shank 209B of the steel body 206B may be fitted into the holder 301B. In this embodiment, the shank 209B may be press-fit into the holder. The washer 210B may be disposed between the shelf 211B of the steel body 206B and the carbide bolster 203B. In this embodiment, the washer 210B may be compressed by the bolster 203 and the shelf 211B, thereby prohibiting rotation of the washer 210B. In other embodiments, the washer may be brazed to the carbide bolster and the shelf of the steel body.

A second washer 350B may be disposed intermediate a flange or base end 302B of the shelf 211B of the steel body 206B and the holder 301B. The second washer 350B may help to reduce wear on the pick during an operation. It is believed that it may be easier and cheaper to replace the second washer 350B rather than replacing the holder 301B.

In the embodiment illustrated in FIG. 3, the distal end of the shaft 207B may be press-fit into the bore 204B of the carbide bolster 203B at an interface 208B. The interface 208B of the shaft 207B may be compliant. It has been found that incorporating a gap 303B between the interface 208B at the distal end of the shaft 207B and the closed end of the bore 204B of the carbide bolster 203B may allow for more compliance of the shaft 207B during an operation, thereby prolonging the life of the pick 101B.

A superhard material 200 may be bonded to a cemented metal carbide substrate 201 at a non-planar interface 304. As illustrated in this figure, a tip 305 of the superhard material 200 may contact the formation 104, causing cracks 306 to form in the formation 104 and thereby breaking up the formation 104.

Figure 3A:
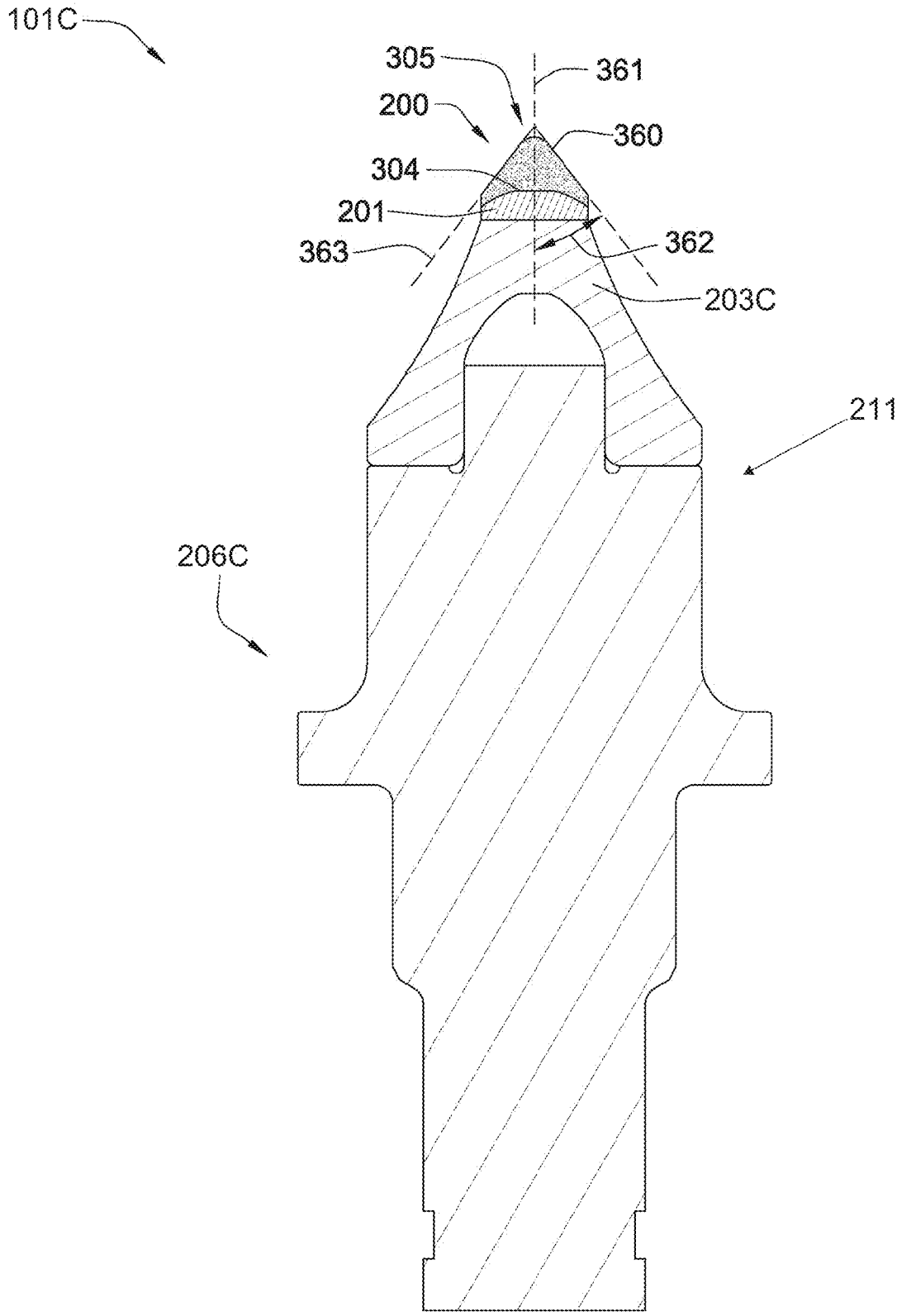
FIG. 3*a* is a cross-sectional diagram of another embodiment of a pick.

Now referring to FIG. 3*a*, a pick 101C may comprise a superhard material 200 bonded to a carbide substrate 201 at a non-planar interface 304. A wall 360 and a central axis 361 of the superhard material 200 may generally form a 35 to 45 degree included angle 362. The wall may be at an angle 362 such that if the generally flat portion of the wall 360 is extended, illustrated by a line 363. In the preferred embodiment, the carbide substrate 201, pick body 206C, carbide bolster 203C, and other portions of the pick 101C do not extend beyond the line 363. This may be beneficial in that during a degradation operation, the point of contact between the pick 101 C and a formation occurs at the tip 305 of the superhard material 200 rather than other portions of the pick 101C, thereby prolonging the wear-life of the pick 101C. The base of the carbide bolster 203C is also shown contacting the shelf 211C formed in the steel body 206C.

Figure 4:
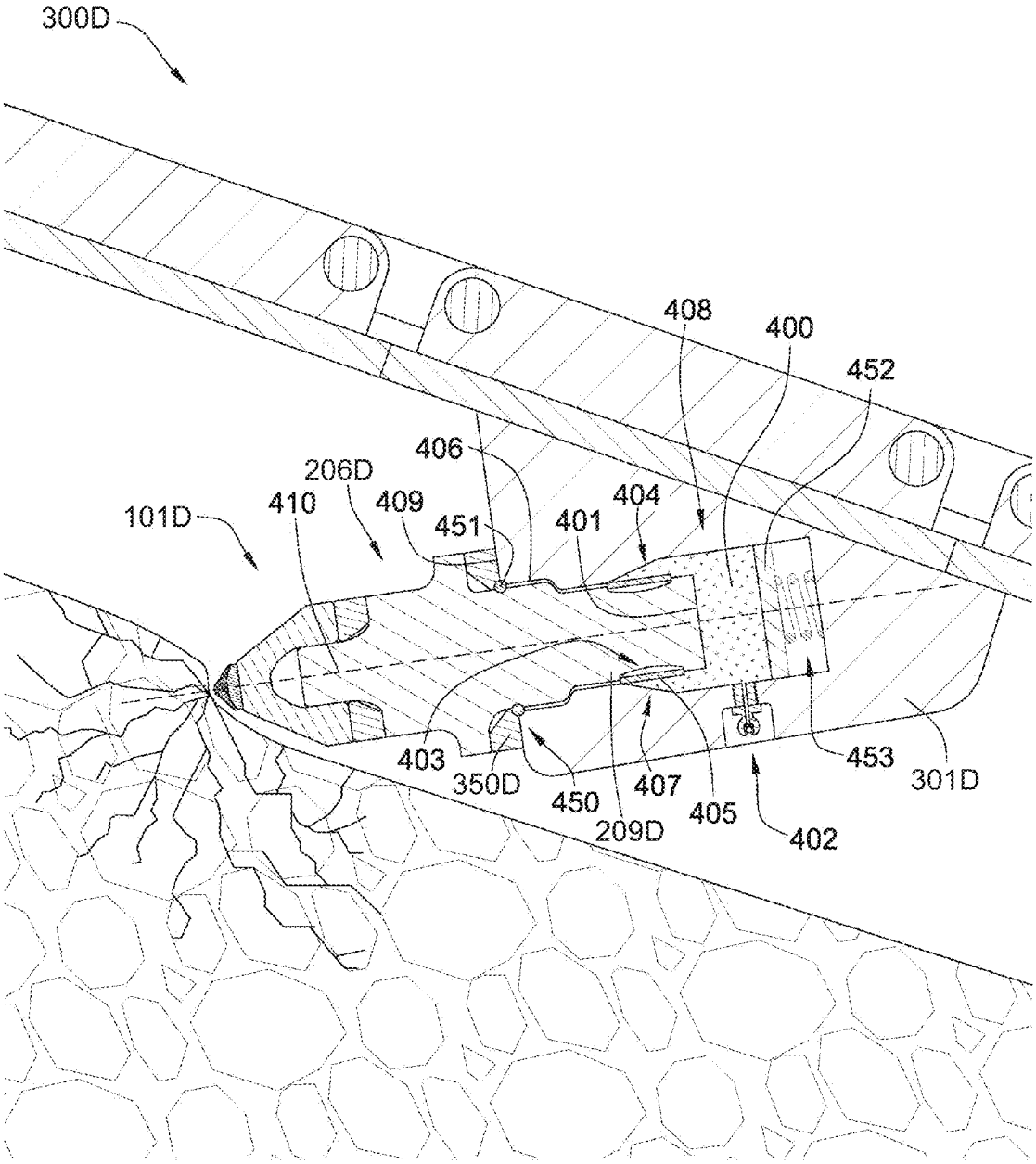
FIG. 4 is a cross-sectional diagram of another embodiment of a degradation assembly.

A degradation assembly 300D shown in FIG. 4 comprises a shank 209D of the pick 101D held within a holder 301D, and with the shank 209D being lubricated. A lubricant reservoir 400 containing fluid may be disposed within the holder 301D adjacent a proximal end 401 of the pick 101D. The lubricant reservoir 400 may supply lubricant to the shank 209D assisting the rotatability of the pick 101D by reducing friction. A seal assembly 450 proximate the opening of a central bore 406 and disposed intermediate the pick 101D and the holder 301D may comprise an O-ring 451 partially disposed in a reentrant proximate a junction of the shank 209D and the body 206D.

The lubricant reservoir 400 may also comprise a plunger 452 and a spring 453 to apply continual pressure on the lubricant. A filling port 402 adjacent to the lubricant reservoir 400 enables outside access to the lubricant reservoir 400 such that additional lubricant may be added to the lubricant reservoir.

The shank 209D may have a reduced diameter portion 403 disposed intermediate the steel body 206D and the proximal end 401 of the shank 209D. A tensioning mechanism 404 comprising a radially expandable spring 405 may be disposed around the reduced diameter portion 403 such that the tensioning mechanism 404 may not slidably move along the length of the shank 209D beyond the reduced diameter portion 403. The outermost diameter of the spring 405 may be larger than the diameter of the shank 209D. The spring 405 may have a diameter less than or equal to the diameter of the shank 209D when the spring is compressed.

The pick 101D may be connected to the holder 301D by placing the shank 209D into the central bore 406; the spring 405 may be compressed as it passes the opening of the bore 406. As the shank 209D reaches a tapered portion 407 of the bore 406 the spring 405 expands in diameter and pulls the pick 101D downward against the holder 301D. The reduced diameter portion 403 of the shank 209D and the spring 405 never reach an expanded diameter portion 408 of the bore 406 yet remain in the tapered portion 407 of the bore 406. Because the spring 405 may be adapted to expand in diameter as the bore 406 diameter increases, the spring 405 may continue to induce an axial tensional force in the shank 209D so long as the spring 405 remains in the tapered portion 407 of the bore 406. The axial tensional force in the shank 209D maintains the connection of the pick 101D to the holder 301D. Moreover, the pick 101D may be rotatable while connected to the holder 301D.

A second washer 350D may be disposed intermediate the pick body 206D and the holder 301D. The holder 301D may have a knurled interface 409 that engages the second washer 350D preventing the second washer 350D from rotating about a central axis 410 without inhibiting the rotatability of the pick 101D. In some embodiments, the tension exerted on the pick 101D by the tensioning mechanism 404 is sufficient enough to substantially rotationally fix the second washer 350D against the holder 301D, even without knurling, while still allowing the pick 101D to rotate.

Figure 5:
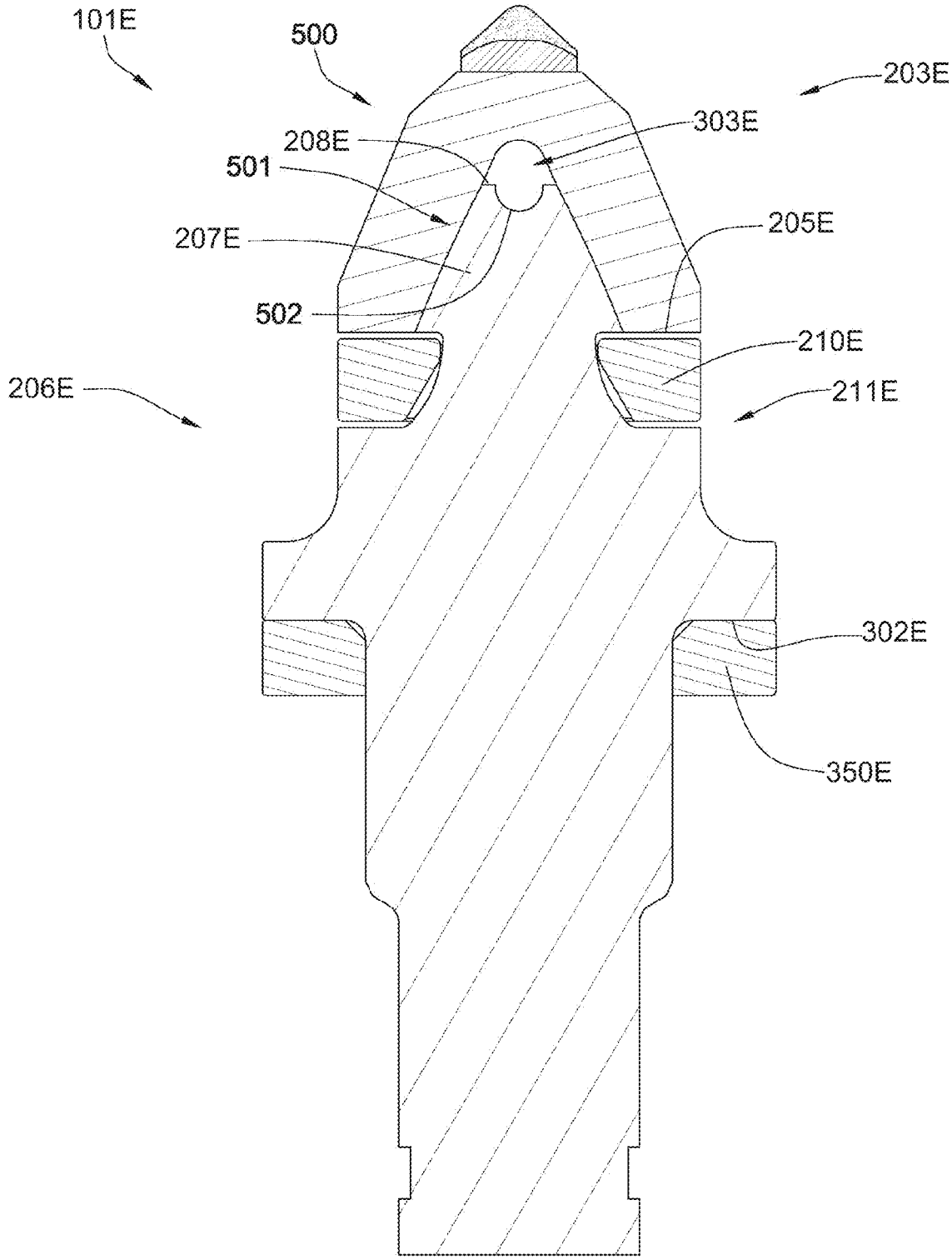
FIG. 5 is a cross-sectional diagram of another embodiment of a pick.
Figure 6:
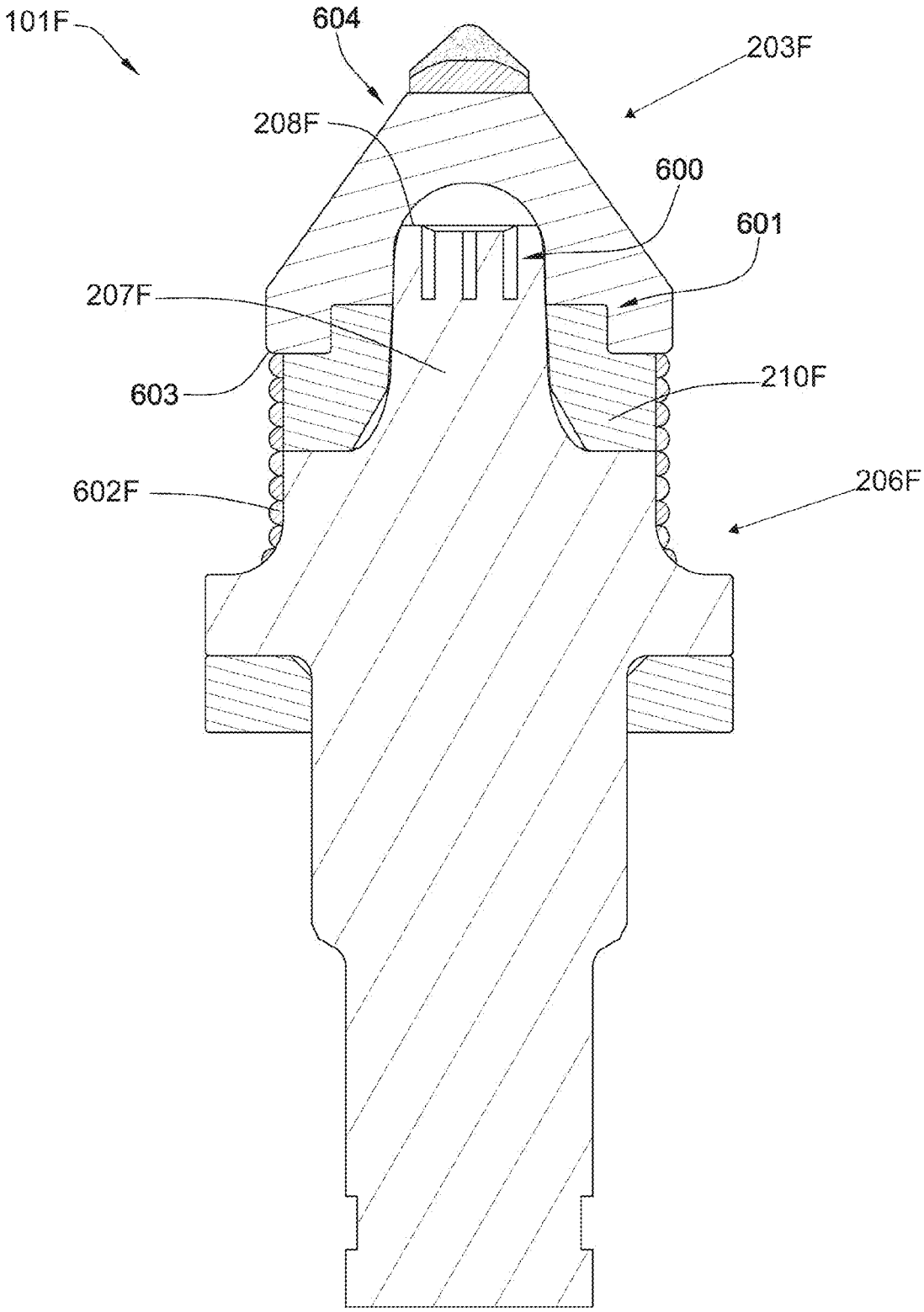
FIG. 6 is a cross-sectional diagram of another embodiment of a pick.
Figure 7:
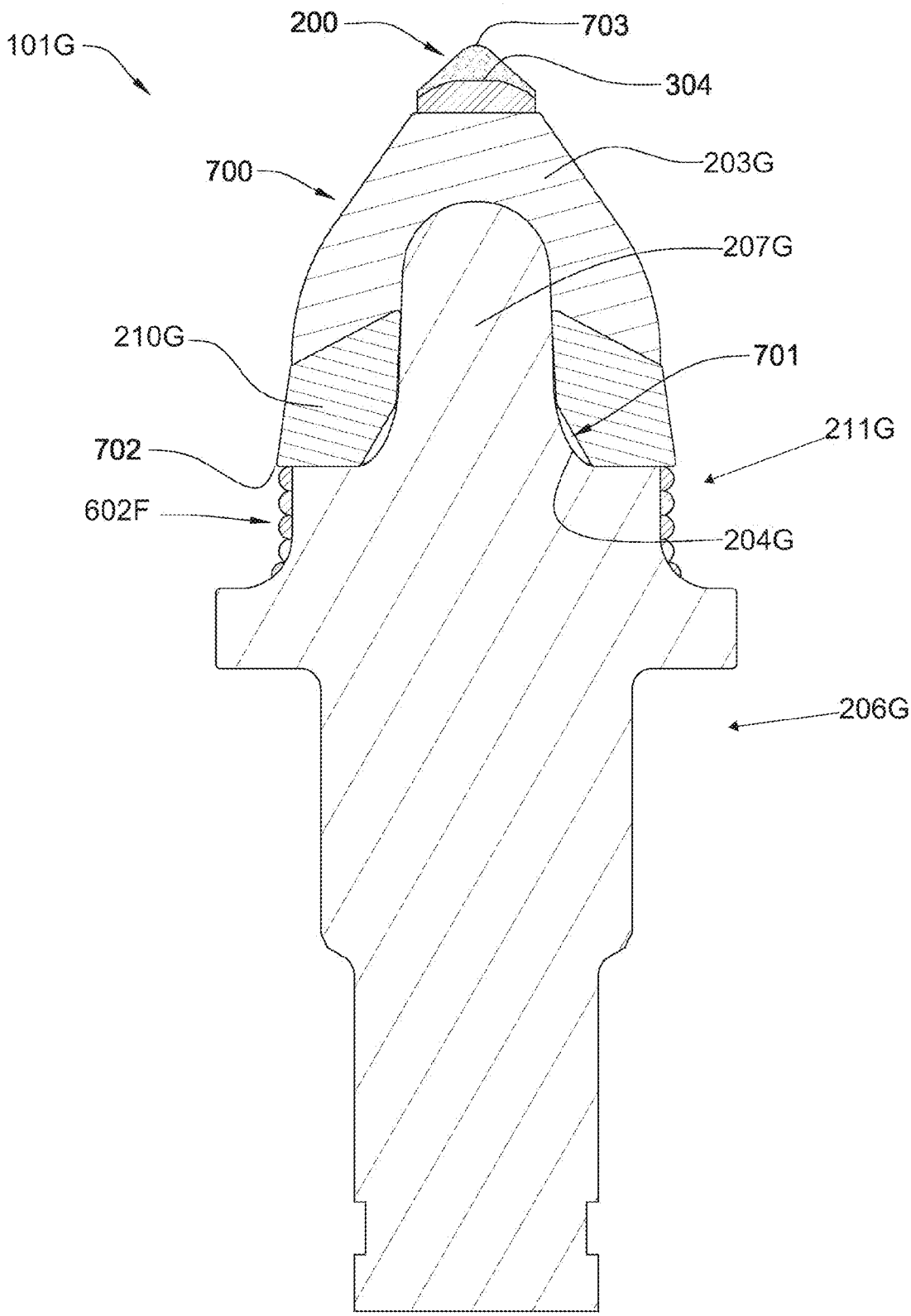
FIG. 7 is a cross-sectional diagram of another embodiment of a pick.

FIGS. 5 through 7 illustrate various additional embodiments of a pick. In the embodiment of FIG. 5, the pick 101E may comprise a washer 210E disposed intermediate the base end 205E of the carbide bolster 203E and the shelf 211E of the steel body 206E. In this embodiment, the washer 210E is not compressed between the base end 205E and the shelf 211E, thus the washer 210E may be adapted to rotate independent of the carbide bolster 203E and the steel body 206E. The washer 210E may comprise a wear-resistant coating.

Also shown in this embodiment of the pick 101E, the shaft 207E of the steel body 206E may comprise a tapered portion 501. Moreover, the interface 208E at the distal end of the shaft 207E may also be compliant, in that the interface 208E may comprise a gap 303E between the closed end of the bore 204E of the carbide bolster 203E and the distal end of the shaft 207E. The gap 303E may be formed, at least in part, by a concavity 502 within the distal end of the shaft 207E.

Also shown in FIG. 5, a second washer 350E may be disposed adjacent a base end 302E of the shelf 211E of the steel body 206E. The carbide bolster 203E may also comprise a segmented geometry 500.

Referring now to FIG. 6, the interface 208F comprises a plurality of slits 600 formed in the steel shaft 207F. In this embodiment, the washer 210F may comprise a stepped geometry 601. The stepped geometry 601 may be beneficial in lowering the cost of the pick assembly by reducing the amount of carbide used in the bolster. A portion of the steel body 206F may comprise a hardfacing material 602F. In some embodiments, the outer surface of the washer 210F may also comprise the hardfacing material 602. The bolster 203F of the pick 101F may comprise an overhang 603 such that the outer surface of the bolster 203F may align with the hardfacing material 602F. In this embodiment, the bolster 203F may comprise a straight, conical geometry 604.

FIG. 7 illustrates a pick 101G having a carbide bolster 203G comprising a convex conical geometry 700. A portion 701 of the shaft 207G adjacent the bore 204G of the bolster 203G and proximate the shelf 211G of the steel body 206G comprises a concave geometry. The washer 210G may be tapered such that a lesser amount of carbide is required for the carbide bolster 203G. A hard facing material 602G may be disposed about a portion of the steel body 206G. The washer 210G may comprise an overhang 702 so that the outer surface of the washer and the hardfacing material 602G align.

The superhard material 200 may comprise a substantially pointed geometry with an apex 703 comprising a 0.050 to 0.160 inch radius, and a 0.100 to 0.500 inch thickness from the apex 703 to the non-planar interface 304.

Whereas the present invention has been described in particular relation to the drawings attached hereto, it should be understood that other and further modifications apart from those shown or suggested herein, may be made within the scope and spirit of the present invention.

What is claimed is:

1. An impact-resistant pick, comprising:

a superhard material bonded to a cemented metal carbide substrate at a non-planar interface;

the cemented metal carbide substrate being bonded to a front end of a cemented metal carbide bolster;

a bore formed in a base end of the carbide bolster spaced apart from the front end;

a steel body including:

a shelf; and a steel shaft extending from the shelf, the shaft being press-fit into the bore of the bolster at an interface, a portion of the shaft adjacent the bore of the bolster including a concave geometry;

a shank extending from the steel body opposite the shaft; and a washer disposed around the shaft and between the base end of the carbide bolster and the shelf of the steel body.

2. The pick of claim 1, wherein the interface of the shaft is compliant.

3. The pick of claim 1, wherein the press-fit further comprises an interference of 0.0005 to 0.0020 inch.

4. The pick of claim 1, wherein the bore of the carbide bolster comprises a depth of 0.50 to 3 inches.

5. The pick of claim 1, wherein the carbide substrate comprises a thickness of 0.050 to 1.0 inch.

6. The pick of claim 5, wherein the carbide substrate comprises a thickness of 0.050 to 0.300 inch.

7. The pick of claim 1, wherein the superhard material further comprises a substantially pointed geometry.

8. The pick of claim 1, wherein the superhard material is a material selected from the group consisting of diamond, mono crystalline diamond, polycrystalline diamond, sintered diamond, chemical deposited diamond, physically deposited diamond, natural diamond, infiltrated diamond, layered diamond, thermally stable diamond, silicon-bonded diamond, and metal-bonded diamond.

9. A pick, comprising:

a superhard material;

a bolster that includes:

a front end, the superhard material being bonded to the front end; and a base end that includes a bore formed therein;

a body that includes:

a shaft, the bore of the bolster being configured to receive the shaft therein, the shaft including a concave geometry formed in an end of the shaft inserted into the bore, the concave geometry providing a gap between the end of the shaft and a closed end of the bore;

a shank; and a washer disposed around the shaft.

10. The pick of claim 9, wherein the superhard material comprises at least one of diamond, mono crystalline diamond, polycrystalline diamond, sintered diamond, chemical deposited diamond, physically deposited diamond, natural diamond, infiltrated diamond, layered diamond, thermally stable diamond, silicon-bonded diamond, and metal-bonded diamond.

11. The pick of claim 9, wherein the shaft further comprises at least one slit in the end of the shaft inserted into the bore.

12. The pick of claim 9, wherein the shaft is press-fit into the bore.

13. The pick of claim 9, wherein the superhard material further comprises a substantially pointed geometry.

14. The pick of claim 1, wherein the washer does not rotate independently of at least one of the carbide bolster and the steel body.

15. The pick of claim 7, wherein the substantially pointed geometry further comprises an apex that includes a radius of 0.050 to 0.160 inches and a thickness of 0.100 to 0.500 inches from the apex to the non-planar interface.

16. The pick of claim 1, wherein the concave geometry of the portion of the shaft is disposed at an end of the shaft furthest from the shelf of the body, the concave geometry providing a gap between the end of the shaft and an end of the bore.

17. The pick of claim 1, wherein the shaft further comprises at least one slit in an end of the shaft furthest from the shelf of the body.

18. An impact-resistant pick, comprising:

a carbide bolster having a front end and a base end, said base end including a closed bore formed therein;

a superhard material bonded to said front end;

a body including:

a shaft having a distal end with at least one slit formed therein, said distal end being inserted into said bore; and a shank; and a washer disposed around said shaft.

19. The pick of claim 18, wherein said superhard material further comprises at least one of diamond, mono crystalline diamond, polycrystalline diamond, sintered diamond, chemical deposited diamond, physically deposited diamond, natural diamond, infiltrated diamond, layered diamond, thermally stable diamond, silicon-bonded diamond, and metal-bonded diamond.

20. The pick of claim 18, wherein said shaft is press-fit into said bore.

21. The pick of claim 18, further comprising a concave geometry formed into one of said distal end of said shaft and a side of said shaft.

22. The pick of claim 21, wherein said concave geometry provides a gap between said distal end of said shaft and a closed end of said bore.

23. The pick of claim 18, wherein said body further comprises a shelf having a first diameter.

24. The pick of claim 23, wherein said shaft extends distally from said shelf and comprises a second diameter smaller than said first diameter.

25. The pick of claim 23, wherein said washer is disposed between said base end of said carbide bolster and said shelf of said body.

26. The pick of claim 9, wherein the shaft includes another concave geometry spaced apart from the end of the shaft inserted into the bore.

* * * * *